United States Patent [19]

Commeyras et al.

[11] 4,394,225

[45] Jul. 19, 1983

[54] PROCESS FOR THE ADDITION OF IODOPERFLUOROALKANES ONTO ETHYLENIC OR ACETYLENIC COMPOUNDS BY ELECTROCATALYSIS

[75] Inventors: Auguste Commeyras, Clapiers; Patrick Calas, Montpellier, both of France

[73] Assignee: Produits Chimiques Ugine Kuhlmann, Courbevoie, France

[21] Appl. No.: 278,609

[22] Filed: Jun. 29, 1981

[30] Foreign Application Priority Data

Jul. 8, 1980 [FR] France ..... 80 15121

[51] Int. Cl.[3] ..... C25B 3/10

[52] U.S. Cl. ..... 204/59 R; 204/72

[58] Field of Search ..... 204/59 R, 59 F, 72, 204/79-81

[56] References Cited

U.S. PATENT DOCUMENTS

| | | | |
|---|---|---|---|
| 3,180,895 | 4/1965 | Harris et al. | 204/81 X |
| 3,455,797 | 7/1969 | Courtier | 204/80 |
| 3,632,489 | 1/1972 | Weinberg et al. | 204/72 |
| 4,097,344 | 6/1978 | Drury | 204/59 R |

*Primary Examiner*—F. Edmundson

*Attorney, Agent, or Firm*—Sigalos & Levine

[57] ABSTRACT

The process for the addition of iodoperfluoroalkanes of the formula $CF_3(CF_2)_nI$, in which n is an integer from 1 to 19, onto ethylenic or acetylenic compounds, by electrocatalysis of the mixture of reactants.

6 Claims, 1 Drawing Figure

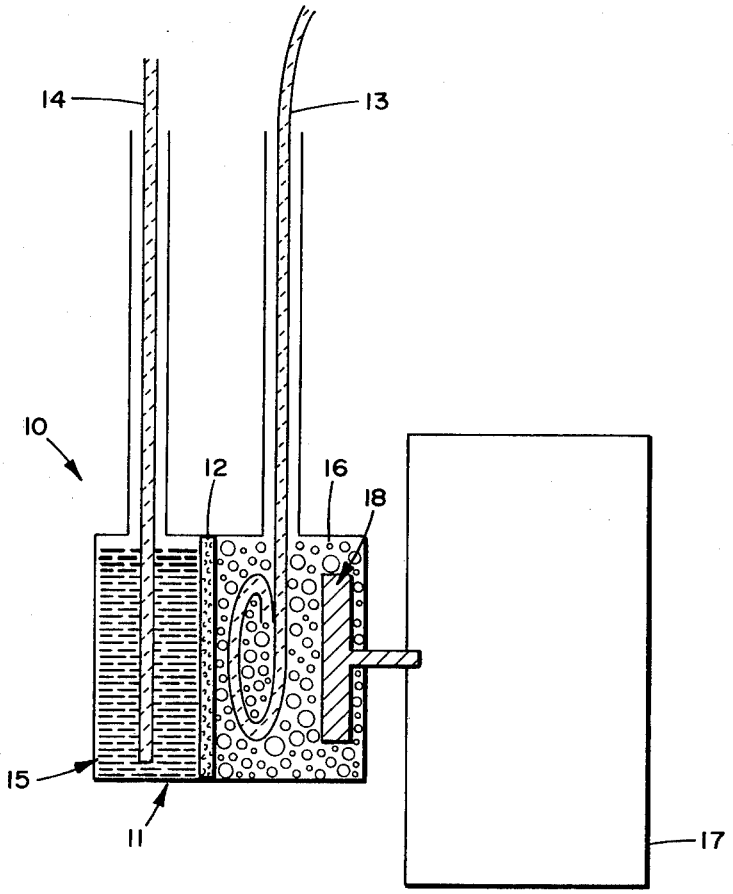
14
13
10
12
16
18
15
11
17

PROCESS FOR THE ADDITION OF IODOPERFLUOROALKANES ONTO ETHYLENIC OR ACETYLENIC COMPOUNDS BY ELECTROCATALYSIS

BACKGROUND OF THE INVENTION

The addition of perfluoroalkane iodides $CF_3(CF_2)_nI$, which are designated hereinafter by the generic term $R_FI$, onto ethylenic or acetylenic compounds leads to products which are used as intermediates in synthesis; such as polyfluorinated halohydrins and epoxides.

Several processes are known, but these give only mediocre yields in the case of ethylenic or acetylenic alcohols and particularly in the case of allyl alcohol.

This addition can, for instance, be carried out by the use of radicals initiating the reaction by an elevation of temperatures (R. N. Haszeldine, J. Chem. Soc. 1953, p. 1199; U.S. Pat. Nos. 3,016,406 and 3,016,407), by irradiation with ultraviolet rays (R. N. Haszeldine's article cited above; J. D. Park, J. Org. Chem. 26, 1961, p. 2086, and D. Cantacuzene, J. Chem. Soc. Perkin I, 1977, p. 1365), or by means of azoic derivatives (N. O. Brace, J. Org. Chem. 27, 1962, p. 3027, and U.S. Pat. Nos. 3,083,224, 3,145,222, and 3,257,407).

It is likewise possible to catalyze the addition by Assher's system (J. Chem Soc. 1961, p. 2261), with the catalyst being a mixture of cuprous and cupric salts and of amines. This process was extended to fluorinated molecules by D. J. Burton (Tetrahedron Letters 1966, p. 5163), N. O. Brace (J. Org. Chem 44, 1979, p. 212) and described in French Pat. No. 2,103,459.

Although all of these systems make it possible to add $R_FI$ onto an ethylenic compound, they present the drawback of resulting only in mediocre and very variable yields, depending on the nature of the initiator and the nature of the olefin used. A universal catalyst does not exist and, in particular, there is no system capable of causing the quantitative addition of $R_FI$ onto ethylenic alcohols. Thus, the photochemical addition according to J. D. Park, or the process described in French Pat. No. 2,103,459, yield a degree of conversion of only 50-55% with allyl alcohol.

SUMMARY OF THE INVENTION

Applicants have invented a process for the addition of iodoperfluoroalkanes to unsaturated compounds by electrocatalysis, which leads to practically quantitative yields.

Briefly stated, the invention comprises the process of addition of iodoperfluoroalkanes of the formula $CF_3(CF_2)_nI$, in which n is an integer from 1 to 19, onto the ethylenic or acetylenic compounds; preferably alcohols or ethers, by electrocatalysis of the mixture of reactants.

BRIEF DESCRIPTION OF THE DRAWING

The single FIGURE of the drawing is a schematic cross-sectional view of an electrolytic cell suitable for carrying out the electrocatalysis of the present invention.

DETAILED DESCRIPTION

While a variety of unsaturated compounds can be reacted with the iodoperfluoroalkanes, it is preferred to use unsaturated alcohols and ethers and the invention will be described in connection with the especially preferred unsaturated ethylenic and acetylenic alcohols and ethers having the unsaturation between the second and third carbon atoms.

With allyl alcohol, for instance, one first obtains the corresponding polyfluorinated iodoalcohol and then on continuing the electrolysis, the epoxide is obtained by the elimination of hydrogen iodide.

$$R_FI + CH_2{=}CH{-}CH_2OH \longrightarrow R_F{-}CH_2{-}CHI{-}CH_2OH$$

$$R_F{-}CH_2{-}CHI{-}CH_2OH \longrightarrow R_F{-}CH_2\underset{\underset{O}{\diagdown\ \diagup}}{CH{-}CH_2} \quad -HI$$

The iodide ions having been produced migrate towards the anode where they are oxidized with the formation of iodine which settles in the anolyte in the form of elementary iodine.

The halohydrin formation phase and the epoxide formation phase are successive or simultaneous depending on the current density being applied.

The process of the invention can be applied to acetylenic alcohols. Thus, propargyl alcohol yields a mixture of ethylenic iodoalcohol and acetylenic alcohol:

$$R_FI + CH{\equiv}C{-}CH_2OH \rightarrow R_FCH{=}CICH_2OH + R_FC{\equiv}CCH_2OH$$

The ethylenic alcohol is present in the two forms cis and trans.

Ethylenic ethers can likewise fix $R_FI$ under the operating conditions described. Diallyl ether, $CH_2{=}CH{-}CH_2{-}O{-}CH_2{-}CH{=}CH_2$, for instance yields the following compound by electrocatalysis:

$$R_F{-}CH_2{-}\underset{\underset{\underset{O}{\diagdown\ \diagup}}{CH_2\ \ CH_2}}{CH{-}CH}{-}CH_2I$$

All of these products are intermediates and can be used for the manufacture of fluorinated surfactants and for obtaining hydrophobic and oleophobic derivatives useful, in particular, for the treatment of textiles, leather, paper, and the like.

The reaction can be carried out in a solvent medium or in aqueous emulsion, depending on the cathodic material employed. Thus, with a mercury cathode the reaction will take place in a dimethylformamide (DMF) medium, and with a carbon fiber cathode it is possible to use an aqueous emulsion containing the iodoperfluoroalkane, the unsaturated alcohol and an electrolyte such as KCL. As carbon fibers which can be used as the cathode, we can cite RIGOLOR AGTF 10.000 fibers, long VSC fibers and RVG graphite flosses, which are all products of the Carbone-Lorraine Company.

Although the invention can be carried out with all of the cathodic materials and the use of solutions or emulsions the process presents the maximum of advantages when it is implemented under the latter conditions with a carbon fiber cathode and an aqueous emulsion containing the reactants. These advantages are:

Absence of by-product, of catalyst, and of solvent which constitute many risks of pollution.

Easy separation of the compound obtained.

Feasibility of working on very concentrated solutions, which economizes on energy required for the separation of the products and increases the productivity of the installations.

The very high electrical conductivity of the medium permits the use of low voltage and high amperage.

Direct recovery of the iodine in the elementary form in the case of epoxide preparation.

Ease of resolving the problem of the membrane separating the two compartments of the cell with a material which cannot be wetted by the organic phase.

The Faraday yield varies with the type of cell used. It is excellent for cells having a mercury cathode and clearly less favorable for cells having a carbon fiber cathode. Nevertheless, the formation phase of the addition compound formed by the reaction of the $R_FI$ with the olefin or the acetylenic compound is always electrocatalytic with an electric current consumption clearly below 1 Faraday per mole, whereas the epoxide formation phase is not electrocatalytic and requires at least 1 Faraday per mole of product formed.

The ohmic drop in the cell depends closely on the geometry of the assembly (connection, wiring, and the like) and on the aqueous phase/organic phase ratio of the catholyte. However, it remains small as compared to the values encountered in organic electrochemistry. It varies from about 4 to 10 volts depending on the current intensities used.

The invention will be further described in connection with the examples which follow which are set forth for purposes of illustration only.

EXAMPLE 1

A cell of the Moinet type as described in Bull. Soc. Chim. Fr., 1969, p. 690, is used. The electrodes are a mercury cathode having a diameter of 6 cm and an anode of platinum wire gauze. The electrolysis potential is controlled by a calomel reference electrode saturated with KCl, referred to as "ECS" and the conditions of the electrolysis are as follows:

| | |
|---|---|
| Electrolysis potential: −0.750 v/ECS | |
| Anolyte: 25 ml 0.1M DMF in $LiClO_4$ | |
| Catholyte: | 35 ml 0.1M DMF in $LiClO_4$ |
| | 3 ml $C_6F_{13}I$ |
| | 2.5 ml $CH_2{=}CH{-}CH_2OH$ |

The monoelectronic reduction of the perfluorinated iodoalkane would require 1258 coulombs. After the flow of only 60 coulombs we observe the complete conversion of the $C_6F_{13}I$ into the holohydrin $C_6F_{13}{-}CH_2{-}CHI{-}CH_2OH$. Electric yield: 21.6 moles of $R_FI$ converted per Faraday consumed.

EXAMPLE 2

A cell 10 as shown in the single FIGURE of the drawing is used comprising a body 11 divided by fritted glass separator 12. A carbon fiber cathode 13, made of RIGOLOR AGTF 10.000 fiber from the Carbone-Lorraine Company which is obtained by the pyrolysis of CRYLOR fiber, is used and anode 14 is a carbon electrode (arc electrode having a diameter of 6 mm). Anolyte 15 is a saturated aqueous KCL solution, while catholyte 16 contains:

| | |
|---|---|
| Saturated aqueous KCL solution | 2 ml |
| $CH_2{=}CHCH_2OH$ | 4 ml |

-continued

| | |
|---|---|
| $C_4F_9I$ | 6 ml |

The catholyte is agitated by means of a magnetic agitator 17 which rotates magnetic bar 18.

With a current of 0.2 A, a degree of conversion into $C_4F_9CH_2CHICH_2OH$ of 90% is obtained in 1 hour.

If electrolysis is continued, the progressive conversion of the halohydrin into the epoxide

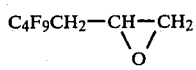

is observed.

EXAMPLES 3 to 6

In these examples $R_F$ is $C_4F_9$.

Example 2 is repeated while causing the intensity of the electrolysis current to vary. The results in terms of percentage conversion are shown in Table I below:

TABLE I

| Example No. | T (min) / I (amp) | 15 | 30 | 60 | 120 | 240 | |
|---|---|---|---|---|---|---|---|
| | | | 10 | 35 | 50 | 80 | % of (1) |
| 3 | 0.1 | | 0 | 0 | 0 | traces | % of (2) |
| | | 5 | 60 | 90 | 70 | | % of (1) |
| 4 | 0.2 | 0 | 0 | traces | 20 | | % of (2) |
| | | 30 | 50 | 70 | 40 | 0 | % of (1) |
| 5 | 0.3 | | traces | 10 | 50 | 100 | % of (2) |
| | | 50 | 80 | 60 | 0 | | % of (1) |
| 6 | 0.6 | traces | 10 | 40 | 100 | | % of (2) |

The percentages of (1) and (2) are given in relation to the $R_FI$ at the start.

(1) = $R_F{-}CH_2{-}CHI{-}CH_2$ (OH)

(2) = $R_F{-}CH_2{-}CH{-}CH_2$ (O)

It should be noted that for Example 4 the electric yield for the conversion of the $R_FI$ into the halohydrin at the time of 60 minutes amounts of 0.25 Faradays per mole of $R_FI$ at the start.

EXAMPLE 7

The cell defined in Example 2 is used.

The catholyte is charged with 2 ml of $H_2O$ saturated with KCL, 4 ml of propargyl alcohol $CH{\equiv}C{-}CH_2OH$ and 6 ml of $C_4F_9I$. A current of 0.2 A is applied with the results shown in Table II below.

TABLE II

| Time (min) | 30 | 60 | 240 |
|---|---|---|---|
| % A | 20 | 35 | 0 |
| % B | 40 | 65 | 65 |
| % C | 0 | traces | 35 |

The percentages of A, B, and C are given as molar % based on the $R_FI$ at the outset, with A, B, and C being:

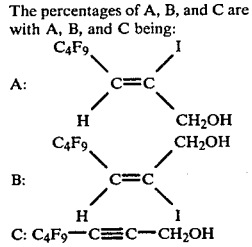

After the formation of addition compounds A and B, we can observe the elimination of hydrogen iodide from A, yielding C. This elimination of HI is caused by the increase of the pH of the catholyte (reduction of the aqueous phase) and takes place only on the compound A in which I and H are in the trans position.

EXAMPLE 8

The cell defined in Example 2 is used.

The catholyte contains:

2 ml of $H_2O$ saturated with KCL;

4 ml of diallyl ether $CH_2{=}CH{-}CH_2{-}O{-}CH_2{-}CH{=}CH_2$ 6 ml of $C_4F_9I$.

TABLE III

| Time (min) | 30 | 60 | 80 |
|---|---|---|---|
| % A | 50 | 80 | 100 |

A: 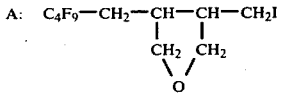

The compound containing $C_6F_{13}$ is obtained in analogous manner. These compounds are soluble in a cetone from which they recrystallize by slow evaporation of the solvent. The NMR analysis of the carbon-13 makes it possible to determine the cis-trans percentage of A (see N. O. Brace, J. Org. Chem. 44, 1979, p. 212).

EXAMPLE 9

Example 2 is repeated by using the chains of $C_6F_{13}I$ and $C_8F_{17}I$ instead of $C_4F_9I$. Two situations are to be considered:

1. The case of $C_6F_{13}I$:

Electrolysis yields quasi-identical results to those obtained for $C_4F_9I$.

2. The case of $C_8F_{17}I$:

For this compound the organic phase has a tendency to be constituted only of $C_8F_{17}I$ with very little allyl alcohol, with the latter preferentially passing into the aqueous phase. Electrolysis then does not lead to any reaction with the $C_8F_{17}I$.

This difficulty is resolved by subjecting a mixed phase of $C_4F_9I+C_8F_{17}I$, in a proportion of 20% of $C_4$ by volume, to electrolysis We then observe the formation of the expected products. With a current of 0.2 A we obtained the following results:

TABLE IV

| Time (min) | 0 | 30 | 60 | 240 |
|---|---|---|---|---|
| $C_4F_9I$ | 28% | 11 | traces | traces |
| $C_8F_{17}I$ | 72 | 29 | traces | traces |
| $C_4F_9{-}CH_2{-}CHI{-}CH_2OH$ | 0 | 17 | 25 | traces |
| $C_8F_{17}{-}CH_2{-}CHI{-}CH_2OH$ | 0 | 43 | 65 | traces |
| $C_4F_9{-}CH_2{-}CH{-}CH_2$ (O) | 0 | 0 | traces | 26 |
| $C_8F_{17}{-}CH_2{-}CH{-}CH_2$ (O) | 0 | 0 | traces | 70. |

The compositions are shown in molar %.

The two epoxides formed can be separated by distillation; they are colorless, dense liquids (d—1.75).

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for the addition of an iodoperfluoroalkane of the formula $CF_3(CF_2)_nI$, in which n is an integer from 1 to 19, onto an ethylenic or acetylenic alcohol or ether having the unsaturation between the second and third carbon atoms, comprising forming a mixture of said alkane and said alcohol or ether and subjecting said mixture to electrocatalysis in an electrolytic cell.

2. The process according to claim 1 in which the mixture of reactants is an organic solvent medium or an aqueous emulsion.

3. The process of claim 1 in which the cathode of the electrolytic cell is selected from a carbon fiber or mercury cathode.

4. The process of claim 1, 2, or 3 in which the compound is an alcohol or an ether.

5. The process of claim 1, 2, or 3 in which the compound is allyl alcohol and the product formed by electrocatalysis is a polyfluorinated halohydrin $R_FCH_2{-}CHI{-}CH_2OH$.

6. The process of claim 1, 2, or 3 in which the compound is allyl alcohol and in which the electrocatalysis is followed by an electrolysis resulting in the epoxide

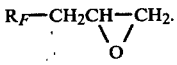

* * * * *